US006428672B1

(12) United States Patent
Choi et al.

(10) Patent No.: US 6,428,672 B1
(45) Date of Patent: Aug. 6, 2002

(54) APPARATUS AND METHOD FOR MANUFACTURING NI—FE ALLOY THIN FOIL

(75) Inventors: Janghyun Choi, Pusan; Taihong Yim, Kyoungki-do; Tak Kang, Seoul; Heungyeol Lee; Joongbae Lee, both of Kyoungki-do; Sanghyun Jeon; Yongbum Park, both of Seoul, all of (KR)

(73) Assignees: Union Steel Manufacturing Co., Ltd., Pusan; Korea Institute of Industrial Technology, Chungnam, both of (KR)

( * ) Notice: Subject to any disclaimer, the term of this patent is extended or adjusted under 35 U.S.C. 154(b) by 0 days.

(21) Appl. No.: 09/600,889

(22) PCT Filed: Dec. 7, 1999

(86) PCT No.: PCT/KR99/00742

§ 371 (c)(1),
(2), (4) Date: Aug. 16, 2000

(87) PCT Pub. No.: WO00/68465

PCT Pub. Date: Nov. 16, 2000

(30) Foreign Application Priority Data

May 6, 1999 (KR) ..... 99-16185

(51) Int. Cl.[7] ..... C25D 1/04

(52) U.S. Cl. ..... 205/77; 204/212; 204/216; 205/97; 205/148; 205/259

(58) Field of Search ..... 205/76, 77, 97, 205/148, 259; 204/206, 208, 212, 216

(56) References Cited

U.S. PATENT DOCUMENTS

| | | | | |
|---|---|---|---|---|
| 3,887,440 A | * | 6/1975 | Ichioka | 204/13 |
| 4,102,756 A | | 7/1978 | Castellani et al. | |
| 4,529,486 A | | 7/1985 | Polar | |
| 4,898,647 A | | 2/1990 | Luce et al. | |
| 4,956,053 A | | 9/1990 | Polar et al. | |
| 6,153,077 A | * | 11/2000 | Kato et al. | 205/77 |

FOREIGN PATENT DOCUMENTS

| | | | |
|---|---|---|---|
| EP | 271283 | A1 | 7/1988 |
| EP | 564151 | A2 | 10/1993 |
| EP | 598517 | A1 | 5/1994 |
| JP | 58-136795 | A | 8/1958 |
| JP | 63-203786 | A | 8/1958 |
| JP | 58-197289 | A | 11/1983 |
| JP | 4-221091 | A | 10/1992 |
| JP | 6-25886 | A | 2/1994 |
| JP | 11100693 | A | 4/1999 |

OTHER PUBLICATIONS

F. A. Lowanhtin, Electroplating, McGraw–Hill Book Co., New York 1978, pp 139.*

* cited by examiner

*Primary Examiner*—Donald R. Valentine
*Assistant Examiner*—William T. Leader
(74) *Attorney, Agent, or Firm*—Bacon & Thomas

(57) ABSTRACT

Disclosed is a technique for manufacturing a Ni—Fe alloy thin foil using a single-step electrodeposition-based plating process without requiring processes such as melting, casting, forging, and rolling. A manufacturing apparatus is provided which includes an electrolyzer adapted to receive an electrolyte containing, as a major component thereof, a solution of nickel and iron compounds, a cathode partially dipped in the electrolyte and arranged in such a fashion that it is rotatable, an anode completely dipped in the electrolyte and arranged in such a fashion that it faces the cathode while being spaced apart from the cathode by a desired distance, and a current supply device adapted to generate a flow of current between the cathode and the anode, whereby a Ni—Fe alloy thin film is electrodeposited to a desired thickness over a surface of the cathode facing the anode, and then peeled off from the surface of the cathode, so that a continuous Ni—Fe alloy thin foil is manufactured.

12 Claims, 3 Drawing Sheets

APPARATUS AND METHOD FOR MANUFACTURING NI— FE ALLOY THIN FOIL

This application is a 371 of PCT/KR99/00742 Dec. 7, 1999.

TECHNICAL FIELD

The present invention relates to an apparatus for manufacturing thin foil made of an Ni—Fe alloy as a soft magnetic material, and more particularly to an apparatus for manufacturing a continued (i.e., continuous) Ni—Fe alloy thin foil using an electrodeposition process.

BACKGROUND ART

Permalloy is a commercially-available Ni—Fe alloy usable as a soft magnetic material. As well known, permalloy exhibits a high magnetic permeability and a low core loss, as compared to other soft magnetic material.

Conventionally, thin foils made of such an Ni—Fe alloy are being manufactured using a method involving melting, casting, forging, and rolling processes.

U.S. Pat. No. 4,948,434 discloses the manufacture of thin foils having a thickness of 0.1 mm or less. In accordance with U.S. Pat. No. 4,948,434, a multi-stage rolling machine is used to conduct a cold rolling process and an annealing process in a multi-step fashion in order to fabricate thin foils having a thickness of 0.1 mm or less. This will now be described in more detail.

In accordance with U.S. Pat. No. 4,948,434, an Ni—Fe alloy sheet is first prepared by hot-working a material essentially consisting of nickel from 76 to 81 wt %, molybdenum from 3 to 5 wt %, boron from 0.0015 to 0.0050 wt %, and the balance being iron and incidental impurities. The prepared Ni—Fe alloy sheet is sequentially subjected to a primary cold rolling at a reduction ratio of from 50 to 98%, a primary annealing at a temperature ranging from 780° C. to 950° C., a secondary cold rolling at a reduction ratio of from 75 to 98%, and a secondary annealing at a temperature ranging from 950° C. to 1,200° C. Through such multi-step cold rolling and annealing processes, a thin foil having a thickness of 0.1 mm or less is manufactured.

However, the multi-step cold rolling process is complex and lengthy. Furthermore, this process has a difficulty in conducting it.

Meanwhile, U.S. Pat. Nos. 3,652,442 and 4,102,756 disclose an apparatus for electroplating of thin films which includes a stirring means for stirring an electrolyte in the form of a laminar flow in order to deposit, on a cathode plate made of a copper substrate, a metal this film having a uniform thickness and a uniform composition while having a uniform magnetic property. In accordance with the apparatus disclosed in U.S. Pat. Nos. 3,652,442 and 4,102,756, however, it is impossible to manufacture metal thin sheets in a continued fashion because the electrodeposition process used in the apparatus is intermittently conducted.

DISCLOSURE OF THE INVENTION

Therefore, an object of the invention is to provide a new method and apparatus which can be substituted for conventional methods involving a plurality of processes in the manufacture of permalloy thin foils.

Another object of the invention is to provide an apparatus for manufacturing a continued Ni—Fe alloy thin foil having a uniform thickness using a single process.

Another object of the invention is to provide an apparatus for manufacturing a continued Ni—Fe alloy thin foil exhibiting a magnetic anisotropy in a stirring direction of a paddle arranged between a cathode and an anode.

In order to accomplish these objects, the present invention provides an apparatus for manufacturing a continued Ni—Fe alloy thin foil using an electrodeposition process.

In accordance with an aspect, the present invention provides an apparatus for manufacturing a continued Ni—Fe alloy thin foil comprising: an electrolyzer adapted to receive an electrolyte containing, as a major component thereof, a solution of nickel and iron compounds; a cathode partially dipped in the electrolyte and arranged in such a fashion that it is rotatable; an anode completely dipped in the electrolyte and arranged in such a fashion that it faces the cathode while being spaced apart from the cathode by a desired distance; and a current device adapted to generate a flow of current between the cathode and the anode, whereby an Ni—Fe alloy thin film is electrodeposited to a desired thickness over a surface of the cathode facing the anode, and then peeled off from the surface of the cathode, so that a continued Ni—Fe alloy thin foil is manufactured.

In order to manufacture a continued Ni—Fe alloy thin foil, the thin film electrodeposited over the cathode should be easily peeled off. To this end, the electrodeposition process should be conducted under appropriate conditions. In particular, the material and surface condition (surface roughness) of the cathode are important. If any one of the conditions associated with the electrodeposition process is inappropriate, it may then be difficult to peel off the Ni—Fe alloy thin film electrodeposited over the surface of the cathode. Although the electrodeposited alloy thin film is peeled off, the resultant thin foil may be fragile. Otherwise, the thin foil may have a distorted shape. Consequently, it is impossible to obtain a desired Ni—Fe alloy thin foil.

The material and surface condition (surface roughness) of the cathode have a direct influence on the bonding force of the Ni—Fe alloy thin film electrodeposited over the surface of the cathode. In this regard, it is important to use a metallic material exhibiting a high corrosion resistance so that the cathode hardly reacts with an electrolyte used (that is, the cathode is hardly corroded by the electrolyte). It is also important for the cathode to have a surface being as smooth as possible.

To this end, the cathode is made of a metallic material exhibiting a high electrical conductivity and a high corrosion resistance to the electrolyte, for example, stainless steel such as steel of SUS 300 series (JIS standard), titanium, or titanium alloy. The surface of the cathode is also polished to have a surface roughness of 0.5 $\mu$m or less, so that it is as clear as possible.

Also, a support roller, which is adapted to rotatably support the cathode, is preferably made of a non-conductive material exhibiting a high corrosion resistance in order to prevent it from reacting with the electrolyte while avoiding an electrodeposition thereon.

The cathode, which is rotatable, may have a drum shape or a belt shape. Where the cathode has a drum shape, the anode has an arc shape corresponding to the shape of the cathode. On the other hand, where the cathode has a belt shape, the anode has a planar shape.

A paddle, which serves to stir the electrolyte, may be arranged between the drum-shaped cathode and the anode. The paddle may have a configuration in which it pendulates in a circumferential direction of the cathode to stir the electrolyte. Alternatively, the paddle may have a configuration in which it reciprocates straightly in an axial direction of the cathode to stir the electrolyte.

BRIEF DESCRIPTION OF THE DRAWINGS

Other objects and aspects of the invention will become apparent from the following description of embodiments with reference to the accompanying drawings in which.

BEST MODE FOR CARRYING OUT THE INVENTION

Now, the present invention will be described in detail in conjunction with preferred embodiments thereof while referring to the annexed drawings.

Figure 1:
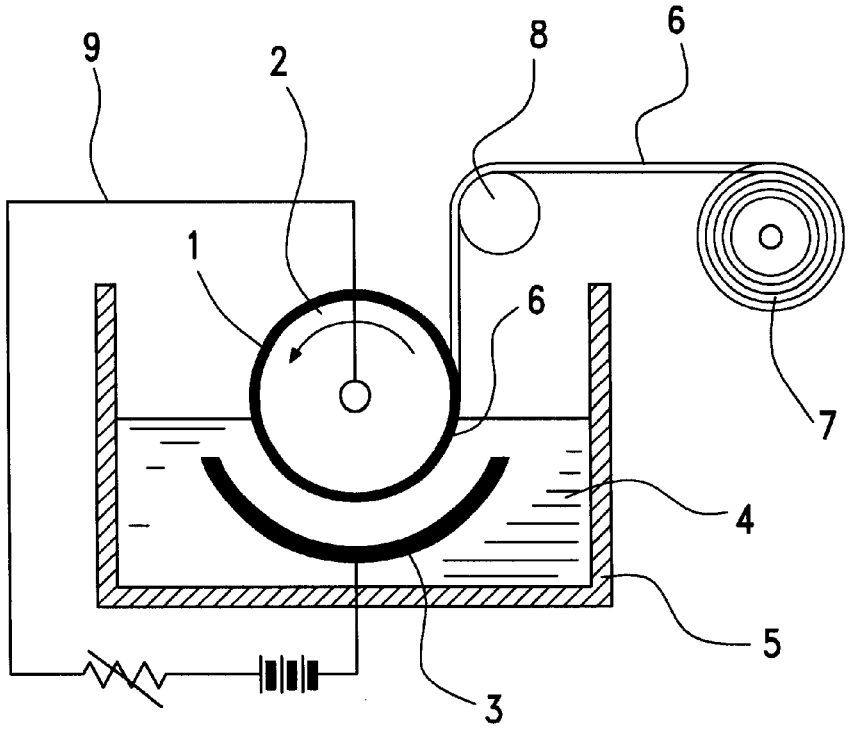
FIG. 1 is a schematic view illustrating an apparatus for manufacturing a continued Ni—Fe alloy thin foil using a drum-shaped cathode in accordance with an embodiment of the present invention.

FIG. 1 illustrates an apparatus for manufacturing a continued Ni—Fe alloy thin foil using a cathode having a drum shape in accordance with an embodiment of the present invention.

Referring to FIG. 1, an electrolyzer 5 is shown in which an electrolyte 4 is filled. The electrolyte 4 contains, as a major component thereof, a solution of nickel chloride and iron sulfate.

In the electrolyte 4, a cathode 1 having a drum shape is dipped. The cathode 1 has a surface roughness of 0.5 $\mu$m or less in accordance with a polishing process. An anode 3 is also dipped in the electrolyte 4 in such a fashion that it surrounds the cathode 1. The anode 3 has a circular cross-sectional shape similar to that of the cathode 1. The anode 3 is uniformly spaced apart from the outer surface of the cathode 1 at its inner surface. For example, the space between the cathode 1 and the anode 3 is 30 to 50 mm, preferably 45 mm.

A support roller 2 is arranged inside the cathode 1 in order to rotatably support the cathode 1. The support roller 2 is made of a non-conductive material in order to prevent it from being eroded by the electrolyte 4 while avoiding an electrodeposition thereon.

Preferably, the cathode 1 is dipped in such a fashion that its rotating shaft 1*a* does not come into contact with the electrolyte 4. Although the rotating shaft 1*a* of the cathode 1 is dipped in the electrolyte 4, there is no affect on an electrodeposition process to be conducted. In such a case, however, there is a possibility of an overflow of the electrolyte 4 from the electrolyzer 5. To this end, it is necessary to provide a separate protecting device, thereby causing the entire configuration of the manufacturing apparatus to be complicated. There is also an adverse affect in terms of productivity.

A current device 9 is arranged between the cathode 1 and the anode 3. The current device 9 is configured to provide an optional adjustment of current density. In accordance with an operation of the current device 9, current flows between the cathode 1 and the anode 3. That is, the current device 9 serves to flow current between the cathode 1 coupled to the negative (−) terminal of a voltage supply source and the anode 3 coupled to the positive (+) terminal of the voltage supply source during a rotation of the cathode 1.

When the cathode 1 is rotated in accordance with a rotation of the support roller 2 while current flows between the cathode 1 and the anode 3 in accordance with the operation of the current device 9, an Ni—Fe alloy is plated in an electrodeposited fashion over the surface of the cathode 1, thereby forming an Ni—Fe alloy thin film.

The thickness of the electrodeposited film can be adjusted by adjusting the rotating speed of the support roller adapted to rotate the cathode 1 and the amount of current supplied by the current device 9.

The Ni—Fe alloy thin film plated to a desired thickness in an electrodeposited fashion over the surface of the cathode 1 is then peeled off in the form of a separate sheet from the surface of the cathode 1. The peeled-off Ni—Fe alloy sheet is fed to a winding device 7 via a guide roller 8 so that it is wound in the form of a roll by the winding device 7.

Figure 2:
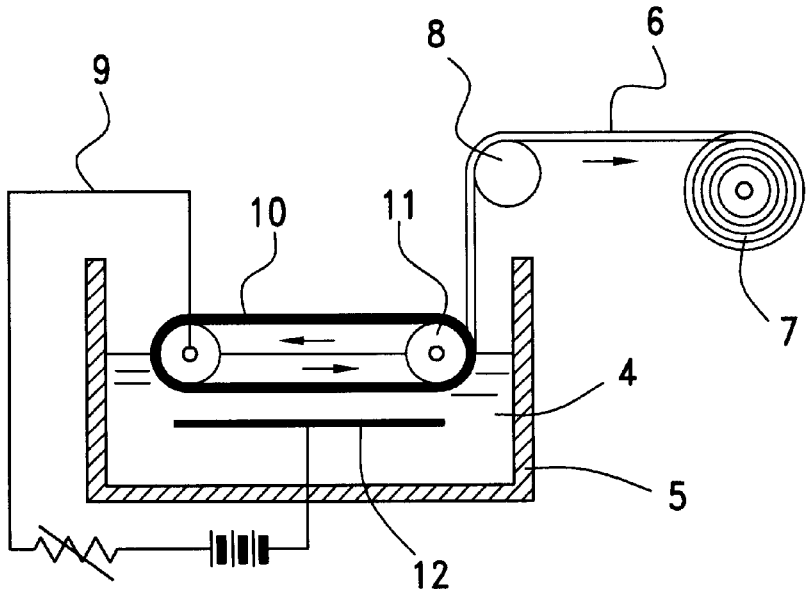
FIG. 2 is a schematic view illustrating an apparatus for manufacturing a continued Ni—Fe alloy thin foil using a belt-shaped cathode in accordance with another embodiment of the present invention.

FIG. 2 illustrates an apparatus for manufacturing a continued Ni—Fe alloy thin foil using a belt-shaped cathode in accordance with an embodiment of the present invention different from that of FIG. 1.

The apparatus of FIG. 2 using the belt-shaped cathode has a configuration similar to that of FIG. 1 using the drum-shaped cathode, except for the shapes of the cathode and anode used.

For the cathode in this embodiment, a cathode belt 10 is used which is formed by welding a metal sheet at opposite ends thereof to have a belt shape. The cathode belt 10 is supported by a pair of spaced rotating rollers 11. The cathode belt 10 is arranged in such a fashion that it is partially dipped in the electrolyte 4. During a rotation of the rotating rollers 11, the cathode belt 10 passes through the electrolyte 4 so that it is partially dipped in the electrolyte 4 in a continued fashion. A planar anode 12 is dipped in the electrolyte 4 in such a fashion that it is arranged in parallel with the cathode belt 10.

The cathode belt 10 is made of the same material as the drum-shape cathode 1 according to the first embodiment. In order to obtain an Ni—Fe alloy thin foil 6 having an optimum clear surface while allowing the Ni—Fe alloy thin foil 6 to be easily peeled off, the cathode belt 10 should be ground at its welded portion to remove traces of the welded portion.

FIGS. 3*a* to 4*b* are views respectively illustrating a device for stirring the electrolyte where a continued Ni—Fe alloy thin foil is manufactured using the above mentioned drum-shaped cathode.

When an Ni—Fe alloy thin film is plated in an electrodeposited fashion over the surface of the cathode 1 while current flows between the cathode 1 and the anode 3 in accordance with an operation of the current device 9, as mentioned above, hydrogen is produced at the cathode 1 by virtue of an electrolysis conducted in accordance with the current flow. Stains may be formed on the electrodeposited Ni—Fe alloy thin film unless the hydrogen produced at the cathode 1 is removed immediately after the production thereof. In severe cases, it is impossible to conduct the electrodeposition due to the stains.

To this end, a paddle is arranged between the cathode 1 and the anode 3 in order to remove hydrogen produced at the cathode 1 by stirring the electrolyte 4.

Figure 3A:
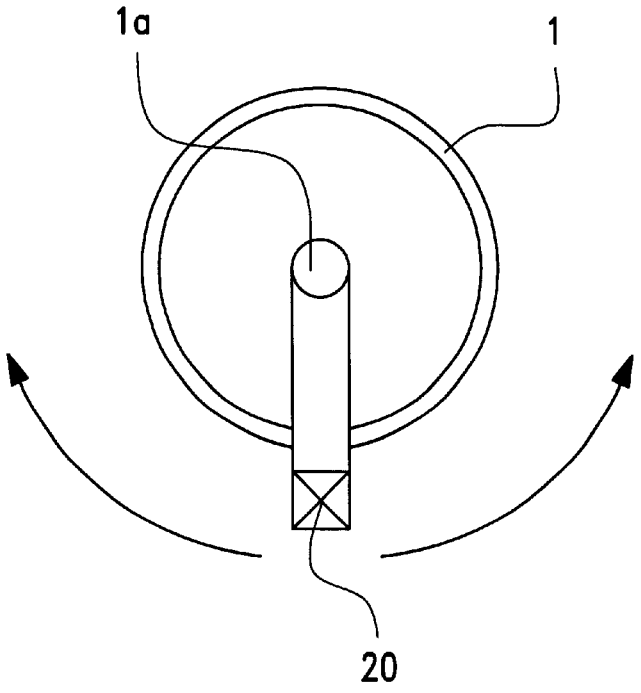
FIGS. 3*a* and 3*b* are a front view and a side view respectively illustrating a method for stirring an electrolyte in a circumferential direction of the cathode by use of a paddle in the apparatus using the drum-shaped cathode.
Figure 3B:
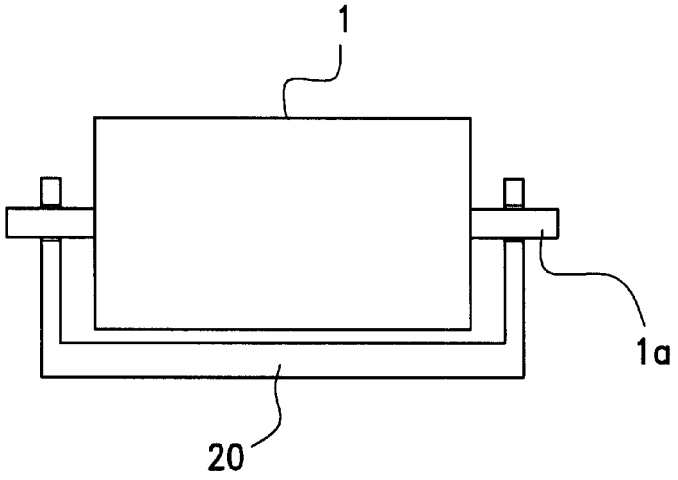
Figure 4A:
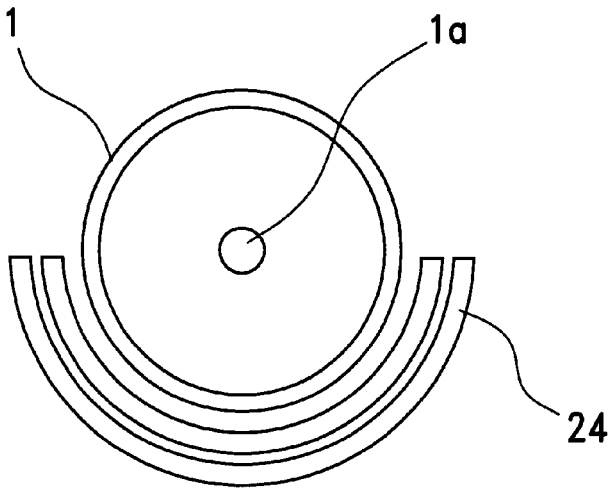
FIGS. 4*a* and 4*b* are a front view and a side view respectively illustrating a method for stirring an electrolyte in an axial direction of the cathode by use of a paddle in the apparatus using the drum-shaped cathode.
Figure 4B:
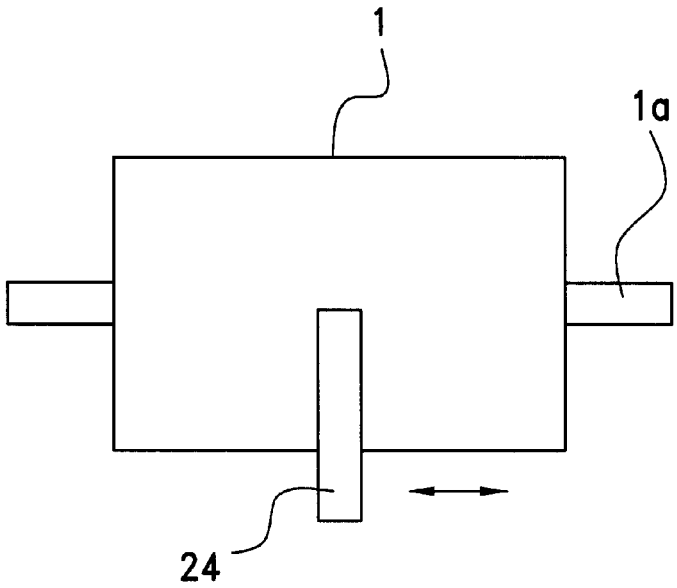

The paddle may have a configuration in which it is movable in a circumferential direction of the cathode 1, as shown in FIGS. 3*a* and 3*b*. Alternatively, the paddle may have a configuration in which it is movable in an axial direction of the cathode 1, as shown in FIGS. 4*a* and 4*b*.

In the case of FIGS. 3*a* and 3*b*, the paddle, which is denoted by the reference numeral 20, is adapted to pendulate around the shaft 1*a* of the cathode 1 in a circumferential direction of the cathode 1, thereby stirring the electrolyte 4.

The paddle 20 includes two rods each rotatably fitted, at one end thereof, around the shaft la of the cathode 1 outside the cathode 1, and a straight bar-shaped paddle portion connected between respective other ends of the rods and adapted to stir the electrolyte 4. Each rod of the paddle 20 has a length slightly greater than the radius of the cathode 1. The paddle portion of the paddle 20 may have an optional cross-sectional shape, for example, a rectangular shape, a triangular shape, or a trapezoidal shape. The paddle 20 is coupled to a separate drive means by means of a link mechanism (not shown) so that it is movable.

The paddle portion of the paddle 20 is arranged between the cathode 1 and anode 3. When the paddle 20 pendulates around the shaft la of the cathode 1 in a state dipped in the electrolyte 4, the paddle portion stirs the electrolyte 4 while pendulating regularly between the facing surfaces of the cathode 1 and anode 3. Since the paddle portion of the paddle 20 pendulates while keeping a uniform space from the surface of the cathode 1, a uniform and efficient electrodeposition is achieved throughout the entire portion of the cathode surface.

In the case of FIGS. 4*a* and 4*b*, the paddle, which is denoted by the reference numeral 24, reciprocates in an axial direction of the shaft 1*a* included in the cathode 1 to stir the electrolyte 4.

The paddle 24 includes a curved bar-shaped paddle portion having a semicircular cross-sectional shape having a radius of curvature slightly greater than that of the cathode 1. The paddle portion of the paddle 24 may have an optional cross-sectional shape, for example, a rectangular shape, a triangular shape, or a trapezoidal shape. The paddle 24 is coupled to a separate drive means by means of a link mechanism (not shown) so that it is movable.

The paddle portion of the paddle 24 is arranged between the cathode 1 and the anode 3. When the paddle 24 reciprocates straightly in an axial direction of the cathode 1 in a state dipped in the electrolyte 4, the paddle portion stirs the electrolyte 4 while reciprocating straightly between the facing surfaces of the cathode 1 and the anode 3. Since the paddle portion of the paddle 24 reciprocates while keeping a uniform space from the surface of the cathode 1, a uniform and efficient electrodeposition is achieved throughout the entire portion of the cathode surface.

In addition to the function for stirring the electrolyte 4, thereby removing hydrogen produced at the cathode 1 to achieve an efficient electrodeposition, the paddle 20 or 24 has an important function associated with the magnetic characteristics of the alloy thin foil to be manufactured.

That is, the present invention has an important feature in that the magnetic anisotropy of the alloy thin foil can be adjusted in accordance with the stirring direction.

Now, a method for manufacturing a continued Ni—Fe alloy thin foil using the above mentioned apparatus according to the present invention will be described in conjunction with the manufacture of an 80 wt % Ni—20 wt % Fe alloy thin foil.

For the electrolyte used in the electrodeposition process involved in the manufacture of 80 wt % Ni—20 wt % Fe alloy thin foil, a solution is used which has a composition consisting essentially of nickel chloride from 102 g/l to 119 g/l, iron sulfate from 5.1 g/l to 11 g/l, boric acid from 19 g/l to 32 g/l, sodium lauryl sulfate from 0.1 g/l to 0.3 g/l, sodium saccharin from 2.2 g/l to 3.1 g/l, sodium chloride from 21 g/l to 39 g/l, and sodium citrate from 3.0 g/l to 6.8 g/l. The electrolyte is adjusted in pH to have a pH of 2 to 3.

Where the electrolyte has a composition other than the above composition, it is difficult to electrodeposit a thin film over the cathode. Although an electrodeposition is achieved in this case, it is difficult to obtain a thin film having a desired composition, that is, an 80 wt % Ni—20 wt % Fe alloy composition. Furthermore, the electrodeposited alloy thin film may be fragile when it is peeled off from the surface of the cathode.

The electrolyte having the above mentioned composition may vary in composition as the electrodeposition process proceeds. In order to maintain a desired composition of the electrolyte, an electrolyte replenishment is conducted. This electrolyte replenishment may be achieved using a general method. In accordance with the present invention, the electrodeposition process is carried out at a temperature of 20 to 65° C., preferably 35 to 50° C., and more preferably 45° C. It was found that when the electrodeposition process is carried out at the above mentioned temperature, an effective electrodeposition of the 80 wt % Ni—20 wt % Fe alloy thin film over the surface of the cathode is achieved.

Where the electrodeposition temperature exceeds 65° C., waste of the electrolyte resulting from an electrolyte evaporation increases greatly. Furthermore, there is a high possibility for the electrolyte to vary in composition. As a result, the 80 wt % Ni—20 wt % Fe alloy thin film electrodeposited over the surface of the cathode may be fragile when it is peeled off from the surface of the cathode.

The anode facing the cathode is uniformly spaced apart from the facing surface of the cathode at all surface portions thereof by a distance of 30 to 50 mm, preferably about 45 mm. It was found that when the space between the cathode and the anode corresponds to the above distance, an effective electrodeposition of the 80 wt % Ni—20 wt % Fe alloy thin film over the surface of the cathode is achieved.

It is also desirable to maintain current supplied by the current device 9 at a density of 50 to 100 $mA/cm^2$ for an effective electrodeposition of the 80 wt % Ni—20 wt % Fe alloy thin film over the surface of the cathode 1. The current density has a relation proportional to the electrodeposition rate. It was found that when the current density increases within the above mentioned range, the electrodeposition rate increases correspondingly within a range from 1.64 $g/cm^2 \cdot min \cdot 10^{-4}$ to 3.37 $g/cm^2 \cdot min \cdot 10^{-4}$, so that it is possible to reduce the plating time for the electrodeposition while manufacturing an 80 wt % Ni—20 wt % Fe alloy thin foil.

Where the current density is less than 50 mA/cm$^2$, a degradation in productivity occurs due to a too slow electrodeposition rate. In this case, there is also a disadvantage in that the plated state of the thin film on the drum-shaped cathode is rough. On the other hand, where the current density is more than 100 mA/cm$^2$, it is difficult to achieve an effective electrodeposition due to a too rapid electrodeposition rate. Although an electrodeposition is achieved in this case, the electrodeposited alloy thin film may be fragile.

The present invention will now be described in detail with reference to the following examples, but the present invention is not to be construed as being limited thereto.

EXAMPLE 1

For the electrolyte 4, an electrolyte was first prepared which had a composition essentially consisting of nickel chloride of 109 g/l, iron sulfate of 5.5 g/l, boric acid of 25 g/l, sodium lauryl sulfate of 0.2 g/l, sodium saccharin of 2.4 g/l, a sodium chloride of 30 g/l, and sodium citrate of 5.0 g/l while being adjusted in pH to have a pH of 2.5. The prepared electrolyte 4 was filled in the electrolyzer 5. In this state, the electrolyte 4 was maintained at a temperature of about 45° C.

For the cathode 1, a cathode having a drum shape was also used which was manufactured using SUS 316 steel to have a width of 40 mm and a diameter 75 mm. After being rotatably supported by the support roller 2, the cathode 1 was dipped in the electrolyte 4 to a depth preventing the rotating shaft 1*a* thereof from coming into contact with the electrolyte 4.

Thereafter, the cathode 1 was rotated at a desired speed, and the paddle 20 was forced to pendulate along the circumference of the rotating cathode 1 in order to stir the electrolyte 4. In this state, a desired amount of current was supplied between the cathode 1 and the anode 3 by the current device 9, thereby electrodepositing an alloy thin film over the surface of the cathode 1. The electrodeposited alloy thin film was then peeled off from the surface of the cathode 1. Thus, an 80 wt % Ni—20 wt % Fe alloy thin foil was manufactured.

The following Table 1 describes the thickness, composition and magnetic permeability of the 80 wt % Ni—20 wt % Fe alloy thin foil depending on a current density and an electrodeposition rate used in Example 1.

By referring to Table 1, it can be found that it is possible to manufacture a continued Ni—Fe alloy thin foil in accordance with Example 1. It can also be found that the manufactured Ni—Fe alloy thin foil has a desired composition, that is, a composition of Ni 80 wt % and Fe 20 wt %. Also, it can be found that the applied current density range is appropriate.

After measuring the magnetic characteristics, namely, the magnetic permeability, of the manufactured 80 wt % Ni—20 wt % Fe alloy thin foil, it was found that in the case of, for example, a two-component-based 80 wt % Ni—20 wt % Fe alloy thin foil manufactured using a current density of 60 mA/cm$^2$, its magnetic permeability at 1 MHz was 2,195 in a direction perpendicular to the stirring direction of the paddle, that is, the width direction of the alloy thin foil, while being 390 in a direction parallel to the stirring direction of the paddle, that is, the longitudinal direction of the alloy thin foil.

EXAMPLE 2

An 80 wt % Ni—20 wt % Fe alloy thin foil was manufactured using the same conditions as those of Example 1, except for the following conditions:

Width and Diameter of Drum-Shaped Cathode 1: 57 mm and 75 mm;

Current Density: 50 mA/cm$^2$; and

Electrodeposition Time: 24 minutes

For the manufactured 80 wt % Ni—20 wt % Fe alloy thin foil, a variation in thickness in a width direction was measured. The results of the measurement are described in the following Table 2.

TABLE 1

| Current | Speed of Drum at Surface | Electro-deposition | Total | | | Fe Component (wt %) | | | | Magnetic Permeability (Measured at 1 MHz) | |
|---|---|---|---|---|---|---|---|---|---|---|---|
| Density (mA/cm$^2$) | Thereof (mm/min) | Rate ($10^{-4}$ g/cm$^2$ · min) | Thickness (microns) | Length (mm) | Width (mm) | Point A | Point B | Point C | Point D | Width Direction | Longitudinal Direction |
| 50 | 10 | 1.64 | 6.4 | 1,800 | 40 | 19.5 | 20.0 | 18.0 | 19.0 | 2,311 | 1,100 |
| 60 | 12 | 2.17 | 6.4 | 1,800 | 40 | 19.5 | 20.5 | 20.5 | 20.0 | 2,195 | 390 |
| 80 | 16 | 2.76 | 6.4 | 1,800 | 40 | — | — | — | — | 2,045 | 1,286 |
| 100 | 20 | 3.37 | 6.4 | 1,800 | 40 | — | — | — | — | 2,166 | 1,357 |

Point A: An intermediate point in a width direction

Point B: a point spaced apart from the intermediate point by 5 mm

Point C: a point spaced apart from the intermediate point by 10 mm

Point D: a point spaced apart from the intermediate point by 15 mm

*The measurement of magnetic permeability was conducted using a figure-of-eight coil method disclosed in Japanese Applied Magnetic Society Journal, volume 17, 1993, pp. 493–496.

*The composition analysis was conducted using EDX attached to SEM.

TABLE 2

| Distance from Edge in Width Direction (mm) | Thickness (microns) | Distance from Edge in Width Direction (mm) | Thickness (microns) |
|---|---|---|---|
| 1 | 23 | 15 | 19 |
| 2 | 22 | 16 | 19 |
| 3 | 21 | 17 | 19 |
| 4 | 20 | 18 | 19 |
| 5 | 19 | 19 | 19 |
| 6 | 19 | 20 | 19 |
| 7 | 19 | 21 | 19 |
| 8 | 19 | 22 | 19 |
| 9 | 19 | 23 | 19 |
| 10 | 19 | 24 | 19 |
| 11 | 19 | 25 | 19 |
| 12 | 19 | 26 | 19 |
| 13 | 19 | 27 | 19 |
| 14 | 19 | 28 | 19 |

Referring to Table 2, it can be found that the alloy thin foil has a uniform thickness of 19 $\mu$m throughout the entire width of 57 mm, except for only opposite lateral edges thereof each having a width of 8 mm.

Of course, it is possible for the alloy thin foil to have a uniform thickness throughout the entire width thereof using a specific additional device.

INDUSTRIAL APPLICABILITY

As apparent from the above description, the present invention provides an apparatus for manufacturing a continued Ni—Fe alloy thin foil, which is capable of continuously manufacturing an Ni—Fe alloy thin foil, namely, a permalloy thin foil, by conducting a single electrodeposition process while rotating a drum or belt-shaped cathode partially dipped in an electrolyte.

In accordance with the present invention, the electrolyte is stirred around the cathode by use of a paddle, thereby preventing the Ni—Fe alloy thin film electrodeposited on the surface of the cathode from being stained with impurities such as hydrogen. It is also possible to control the magnetic anisotropy of the Ni—Fe alloy thin film in accordance with the stirring direction of the paddle.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for manufacturing a continuous Ni—Fe alloy thin foil using an electrodeposition process, comprising:

an electrolyzer adapted to receive an electrolyte;

a drum cathode partially dipped in the electrolyte and arranged in such a fashion that it is rotatable;

an arcuate anode completely dipped in the electrolyte and arranged in such a fashion that it faces the cathode while being spaced apart from the drum cathode by a desired distance, the anode having a surface shape corresponding to that of the drum cathode;

a current device arranged between the cathode and the anode; and a paddle arranged between the cathode and the anode and adapted to pendulate about a rotating shaft of the drum cathode in a circumferential direction of the drum cathode, thereby stirring the electrolyte.

2. The apparatus according to claim 1, wherein the anode is spaced apart from the surface of the cathode by a distance of 30 to 50 mm, at all surface portions thereof facing the cathode.

3. The apparatus according to claim 2, wherein the anode is spaced apart from the surface of the cathode by a distance of 45 mm, at all surface portions thereof facing the cathode.

4. The apparatus according to claim 1, wherein the cathode is made of a metallic material exhibiting no reaction with the electrolyte.

5. A method for forming an 80 wt % Ni-20 wt % Fe alloy thin foil in a continuous fashion using the apparatus of claim 1 wherein:

the electrolyte has a composition consisting essentially of nickel chloride from 102 g/l to 119 g/l, iron sulfate from 5.1 g/l to 11 g/l, boric acid from 19 g/l to 32 g/l, sodium lauryl sulfate from 0.1 g/l to 0.3 g/l, sodium saccharin from 2.2 g/l to 3.1 g/l, sodium chloride from 21 g/l to 39 g/l, and sodium citrate from 3.0 g/l to 6.8 g/l;

the electrolyte has an acidity of pH 2 to pH 3; and the electrolyte is maintained at a temperature of 20 to 65° C.

6. The method according to claim 5, wherein the electrodeposition process is conducted at a rate ranging from 1.64 $g/cm^2 \cdot min \cdot 10^{-4}$ to 3.37 $g/cm^2 \cdot min \cdot 10^{-4}$ and at a current density ranging from 50 $mA/cm^2$ to 100 $mA/cm^2$.

7. An apparatus for manufacturing a continuous Ni—Fe alloy thin foil using an electrodeposition process, comprising:

an electrolyzer adapted to receive an electrolyte;

a drum cathode partially dipped in the electrolyte and arranged in such a fashion that it is rotatable;

an arcuate anode completely dipped in the electrolyte and arranged in such a fashion that it faces the cathode while being spaced apart from the drum cathode by a desired distance, the anode having a surface shape corresponding to that of the drum cathode;

a current device arranged between the cathode and the anode; and a paddle arranged between the cathode and the anode, wherein the paddle is adapted to reciprocate straightly along a rotating axis of the drum cathode, thereby stirring the electrolyte.

8. The apparatus according to claim 7, wherein the anode is spaced apart from the surface of the cathode by a distance of 30 to 50 mm, at all surface portions thereof facing the cathode.

9. The apparatus according to claim 8, wherein the anode is spaced apart from the surface of the cathode by a distance of 45 mm, at all surface portions thereof facing the cathode.

10. The apparatus according to claim 7, wherein the cathode is made of a metallic material exhibiting no reaction with the electrolyte.

11. A method for forming an 80 wt % Ni-20 wt % Fe alloy thin foil in a continuous fashion using the apparatus of claim 7, wherein:

the electrolyte has a composition consisting essentially of nickel chloride from 102 g/l to 119 g/l, iron sulfate from 5.1 g/l to 11 g/l, boric acid from 19 g/l to 32 g/l, sodium lauryl sulfate from 0.1 g/l to 0.3 g/l, sodium saccharin from 2.2 g/l to 3.1 g/l, sodium chloride from 21 g/l to 39 g/l, and sodium citrate from 3.0 g/l to 6.8 g/l;

the electrolyte has an acidity of pH 2 to pH 3; and the electrolyte is maintained at a temperature of 20 to 65° C.

12. The method according to claim 11, wherein the electrodeposition process is conducted at a rate ranging from 1.64 $g/cm^2 \cdot min \cdot 10^{-4}$ to 3.37 $g/cm^2 \cdot min \cdot 10^{-4}$ and at a current density ranging from 50 $mA/cm^2$ to 100 $mA/cm^2$.

* * * * *